United States Patent [19]

May et al.

[11] Patent Number: 4,871,158

[45] Date of Patent: Oct. 3, 1989

[54] VERY HIGH SPEED DUPLICATOR WITH FINISHING FUNCTION

[75] Inventors: Joseph N. May, Fairport, N.Y.; Stephen A. Rhinehart, New Orleans, La.; Robert G. Zambelli, Rochester, N.Y.

[73] Assignee: Xerox Corporation, Stamford, Conn.

[21] Appl. No.: 316,583

[22] Filed: Feb. 27, 1989

[51] Int. Cl.[4] ..... B42B 1/02

[52] U.S. Cl. ..... 270/53; 270/58

[58] Field of Search ..... 270/37, 53, 58

[56] References Cited

U.S. PATENT DOCUMENTS

| | | | |
|---|---|---|---|
| 3,719,266 | 3/1973 | Korn et al. | 198/35 |
| 4,029,309 | 6/1977 | Lynch | 270/53 |
| 4,134,672 | 1/1979 | Burlew et al. | 355/14 |

*Primary Examiner*—David A. Wiecking

[57] ABSTRACT

A copying/finisher system is described as having a compiling station for receiving a collated copy set prior to stapling. The compiling station is defined by a reciprocably movable, horizontally arranged collecting plate upon which the copy sheets are collected. The arrangement presents the leading edge of the sheets to the clamping position of one or more staplers. After collection of the copy sheets, the leading edge of the set is clamped and stapled while the plate is moved to permit dropping of the finishing set.

3 Claims, 2 Drawing Sheets

VERY HIGH SPEED DUPLICATOR WITH FINISHING FUNCTION

This is a continuation of application Ser. No. 859,218, filed May 2, 1986, which in turn was a continuation of Ser. No. 217,326, filed Dec. 17, 1980, both now abandoned.

This invention relates to an improved reproduction system having an improved finishing station for use in such system.

With the advent of higher speed and more sophisticated copy producing machines, printing presses, and the like, consideration as to how the mass of copies generated can best and most effectively be handled has assumed increasing importance. One way has been to provide a reproduction system with an input device in the form of a recirculating document handling apparatus. In this system, a document sheet is removed from a collated set of document sheets, placed on an exposure platen for exposure at the rate of one exposure for each document sheet, and returned to the top of the set in the document handling apparatus until the set of document sheets has been completely circulated through the apparatus, and a copy set has been produced. The set of document sheets is then recycled for the reproduction of a second copy set, and so on. After each copy set is produced and collected at a collection station, a finishing device such as a stitcher or stapler is activated to bind the set. These systems are of the precollation type wherein the document sheets are precollated in the document handling apparatus prior to commencement of a reproduction run. The output for the reproduction machine will likewise be precollated in sets corresponding to the sequenced numbered document set in the document handling apparatus. The copy sheets are collected in collated sets as they are sequentially produced so that binding may be effected without the interaction of additional devices. Such systems are described in U.S. Pat. No. 4,134,672.

One of the disadvantages in these systems having continuous document recirculation to produce each bound copy set in that for compilation of each copy set and eventual stapling or stitching, many moving parts have been required and have added to the risks of unscheduled maintenance. In addition, generally, in providing for the stapling or stitching step, one or more machine pitches are lost thereby reducing throughput for the system.

In order to achieve still higher rates of production of finished copy sets, the present invention contemplates the concept of utilizing a compilation station which includes the stapler or stitcher heads in order to avoid the use of copy set transport devices and permit continuous compilation of successive copy sets.

Present day machines on the market, such as the Xerox duplication machine labeled the 9400 ®Duplicator marketed by Zerox Corporation of Stamford, Connecticut, utilizes a document handler as an input device which exposes as many copies of a single document sheet at a time as is appropriate before starting on the next document sheet. The present invention, however, contemplates utilizing a recirculating type of document handling apparatus such as of the general type disclosed in the above referrred to U.S. Pat. No. 4,134,672. Any other suitable recirculating type of document handler may also be used in conjunction with the processor for the 9400 ®Duplicator.

It is therefore the principal object of the present invention to produce bound sets or stacks of copies of a multi-page document at the highest speed possible for a reproduction machine.

It is a further object of the present invention to maintain full productivity in a reproduction/finishing system by eliminating those machine copy cycle pitches which are wasted during some machine operating steps.

It is another object of the present invention to minimize the number of moving parts in a finishing station for a very high speed copying machine and thereby minimize service calls and down time for the machine.

The present invention includes a finishing apparatus for binding copy sheets received in succession at a sheet compilation station. The compilation station is defined by a movable, horizontally arranged plate upon which sheets are collected, and the stapling heads for two or more stapling apparatus. When the last sheet of a set to be bound is collected, the plate is quickly retracted from the set in timed sequence with the clamping of the stapling heads whereupon the rear edge of the set lowers to carry the set downwardly upon a set collecting, vertically movable tray. A set kicker may be employed to facilitate quick removal of the stapled edge out of the stapling heads. As the stapled set is lowered, the compiling plate is repositioned into its compilation position to catch the first sheet of the succeeding copy set. The collecting plate reciprocates, that is, moves from a collecting position to a retracted position and back to its collection position at a cycle rate approximately equal to the rate of production of the processor for the copying machine so that there is no loss of productivity. In other words, the time during which the plate 102 reciprocates is approximately equal to the pitch time for the machine or that time for a copy sheet to move a distance from the leading edge of one copy sheet to the leading edge of a succeeding sheet regardless of where the sheets are in the system.

In the U.S. Pat. No. 4,134,672, a system is disclosed wherein copy sheets are collected in an inclined tray and requires a set transport device for removal to a set collecting point after a stitching operation. Many moving parts are employed for the finishing step and related timing is critical for all of these parts. In the U.S. Pat. No. 3,719,266, copy sheets are collected in a vertically arranged tray for copy set separation. Another arrangement which collects copy sheets in a vertically inclined collecting tray is disclosed in U.S. Pat. No. 4,029,309. After collection in the tray, a set of copy sheets is clamped and moved to a stapling position.

Other objects and advantages will be apparent from the ensuing description and drawings in which.

Figure 1:
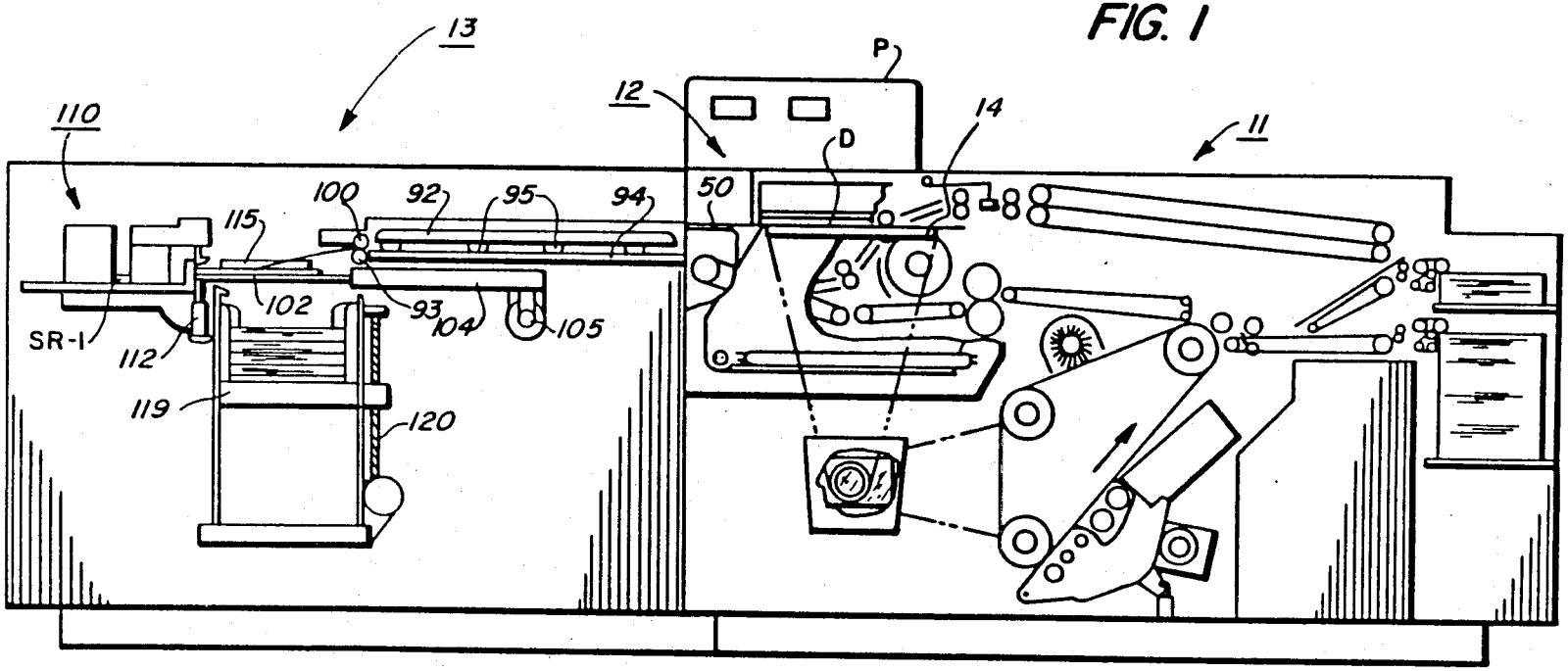
FIG. 1 is a schematic illustration of a configuration of an electrostatographic printing/finishing system employing the present invention.

For a general understanding of a reproduction machine with which the present invention may be incorporated, reference is made to FIG. 1 wherein components of a typical electrostatic printing system are illustrated. The printing system is preferably of the xerographic type as one including a xerographic processor 11, and a recirculating type document handling apparatus 12. Preferably, the processor 11 is the same as the processor in the commercial embodiment of the Xerox duplicator 9400®, which utilizes flash, full frame exposure for very high speed production. Document sheet exposure, image processing and copy sheet transport/handling are under control by a machine programmer and are effected in timed sequence, and in accordance with the program an operator has preset in the machine. Further details in this regard are not necessary since the Xerox 9400®Duplicator operates in this manner and is well known. Details of the timing relationships and related structure and events are described in U.S. Pat. Nos. 3,790,270; 3,796,486; and 3,917,396, commonly assigned and which are incorporated by reference. It will be understood that most any other type of xerographic processor and document handling apparatus may be utilized. Operating in conjunction with the processor 11 and apparatus 12 is a finishing station 13, thereby forming the reproduction system shown in FIG. 1.

The system comprising the processor 11 and the document handling apparatus 12 is under control of a programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, stapled or unstapled; to select one of a plurality of paper trays; to condition the machine for the type of document, that is, whether one sided or two sided, to select a copy size reduction mode, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the microprocessor is one similar to the Intel 8080 Microprocessor manufactured by the Intel Corporation, Santa Clara, California, and having sufficient ROM's and RAM's for all of the necessary functions in the reproduction system.

The document handling apparatus 12 serves to feed one document sheet at a time from a supply of document sheets of a document D into copying position on the platen 14 where a single exposure of each document sheet is made per document set and during sequential operation. Following exposure, each document sheet is automatically returned to the document supply and the next document sheet, if any, is brought into the exposure position on platen 14. Document sheets returned to the supply stack may be recycled by the apparatus 12 in the event additional copy sets are to be produced, or simply removed by the user when the copying program is completed.

While the apparatus 12 has been described as being of the recirculating type, it will be understood that dual mode apparatus may also be utilized, that is, those which circulate documents to effect collated and non-collated copy sets, such as of the type disclosed in U.S. Pat. No. 4,078,787. Further details of the document handling apparatus are not necessary to understand the principles of the present invention.

Figure 2:
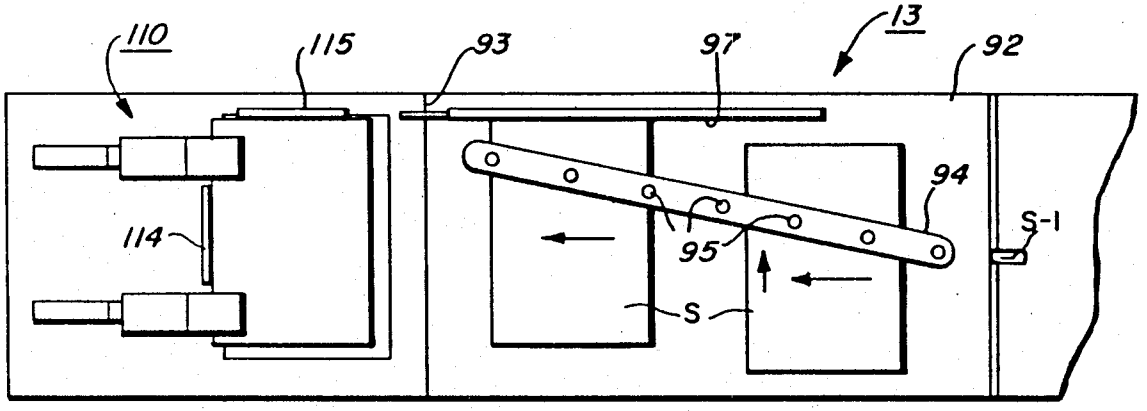
FIG. 2 is an isometric view of the finishing station utilized in the system of FIG. 1.

For either the simplex or duplex modes of operation, copy sheets exiting through the exit slot 50 positioned at one end of the housing for the xerographic processor 11 are directed to the finishing station 13 which comprises a compiling station, a stapler apparatus, and an output elevator system. After leaving the processor 11, as shown in FIG. 2, each sheet is positioned upon a transport 92 to be further conveyed generally along the same horizontal plane as its previous path to a fixed receiving point or station 93. The transport includes a movable endless transport belt 94 upon which each sheet is placed and a plurality of loosely retained rotatable balls 95 which rest on and along the belt 94 by gravity and which coact with the belt to convey sheets therebetween. The belt 94 is driven by a motor and suitable gearing and pulleys (not shown) at a velocity slightly greater than the processing speed of the processor 11 in order to add more working space between the sheets and to ensure that the final handling of copy sheets does not impede the throughput of the entire system as determined by the process speed of the processor 11. The rate at which the sheets arrive at the staion 93 nevertheless is the same as the process speed or reproduction rate of the processor.

It will be noted that the axis of the belt 94 is at a slight angle to the direction of the movement of the copy sheets. This arrangement drives each sheet of copy slightly laterally against a side registration edge 97 which is parallel to and offset from the centerline of the incoming path of sheet movement. As viewed in FIG. 2, the sheet S as can be seen through a sheet clearance opening formed in the top plate of the transport 92. In this orientation, the sheets are positioned so that their toner image side is down, for the simplex mode, or an odd numbered page is down for the duplex copying mode, and the top of each sheet is along the edge 97.

At the exit slot 50, a sheet contacting switch S-1 is positioned to be actuated as each sheet enters the transport 92 of the finishing station 13. The circuit for this switch is connected to the logic in the programmer P and serves to reset the machine clock for the finishing function so that zero time for the sheet commences when the sheet is at the station 93 which serves as the system reference point.

At the receiving station 93, there is positioned a pair of contacting transport rollers or a set of corrugating rollers 100 which receive each copy sheet within the nip for directing a sheet onto a compiling receiving plate 102 located at a compiling station which includes this plate. The plate 102 is suitably mounted for horizontal reciprocable movement between the position showing in FIG. 2 whereat copy sheets are compiled to form a set C just prior to a stapling operation to its retracted position shown in FIG. 3. A pneumatic cylinder 104 having an electromagnetic actuable valve 105 is suitably connected to the plate to provide very fast reciprocable movement upon logic control in the programmer P. The valve 105 is energized by means of a time signal from the programmer logic to drive the plate to the collecting or compiling position of FIG. 1 or to retract the plate to the position shown in FIG. 3.

The rate at which the plate 102 makes a complete reciprocable cycle is approximately equal to the rate of production of the processor, or its pitch per unit of time. For example, if the production rate for the processor is 120 copies per minute, its pitch is one sheet plus one space between sheets per one-half second and the cycle time for reciprocation of the plate will be approximately one-half second.

Also positioned along the far edge of the compiler station is an individually-operable, dual stapler apparatus 110 which provides a stapling function either with a single staple or with two staples, both being adapted to be applied at variable positions along the long edge of a set C of copy sheets. Stapling is achieved by way of two identical mechanisms, each of which provides the functions of copy set clamping, staple driving and staple clinching. Preferably, the apparatus utilizes two commercial type stapler heads 112, such as the Bostitch staple head indicated as the 64-E manufactured by the Bostitch Division of the Textron Corporation of Providence, Rhode Island. The stapling apparatus 110 may be identical to that disclosed in detail in the commonly assigned copending application Ser. No. 180,184, filed Aug. 21, 1980.

In that apparatus, logic timed control signals are imparted to two electromagnetic clutches and one solenoid in order to acquire copy set clamping along the edge of the copy set to be stapled; staple driving which separates a staple from a supply and drives it through the set; and clinching wherein the staple legs are bent to secure the copy sheets. Since further details of the apparatus does not determine the present invention, further description thereof is unnecessary. However, the description of the details disclosed in the above referred to application is hereby incorporated by reference.

During a compiling operation, the receiving plate 102 is in the position shown in FIG. 1 wherein its far edge is adjacent the clamping position for the stapling apparatus. As sheets are conveyed past the reference point 93 by the rollers 100, they are directed upon the plate 102 and into clamping positions relative to the stapler heads 112. As the sheets are being directed into their prestapling position, they engage and become registered against corner registration members 114, 115. The member 114 is positioned between the heads 112 and in spatial arrangement so that when all sheets of a set are against the member, the now aligned edge of the set is in proper position to be clamped and stapled by the stapling heads.

After a stapling operation, a stapled copy set is dropped onto an elevator device 118 which is utilized to collect into a pile stapled or unstapled sets or stacks of copy sheets for delivery to an operator. The elevator comprises a tray 119 mounted in cantilever fashion at the upper ends of a pair of vertically arranged, drive screws 120 threadedly received in threaded members 121 secured one to each side corner of the tray 119, so that upon rotation of the drive screws 126, the tray 119 is moved vertically in the up or down directions. A reversible motor M-1 is operatively connected to the member 121 for imparting rotation to the same in either direction. Elevator height of piles sets or stacks is controlled by an optical sensor SR-1 which "looks" across the pile and effects the energization of the motor M-1 and lowering of the tray 119 until the pile is at or below the sensor.

A typical reproduction run will now be described in order to illustrate the sequence of events which occur during operation of the system of FIG. 1. For this run, it will be assumed the operator programmed the system to produce twenty copy sets of a five sheet document set, in the simplex mode. This program is manually preset in the programmer P and the five document sheets placed in the document handler 12 in precollated arrangement. Upon activation of the system, each page or sheet of the document set is placed upon the plate 14 for exposure, removed therefrom and returned to the stack of document sheets, and so on until the set of five document sheets has been recycled in the document handling apparatus twenty times.

Figure 3:
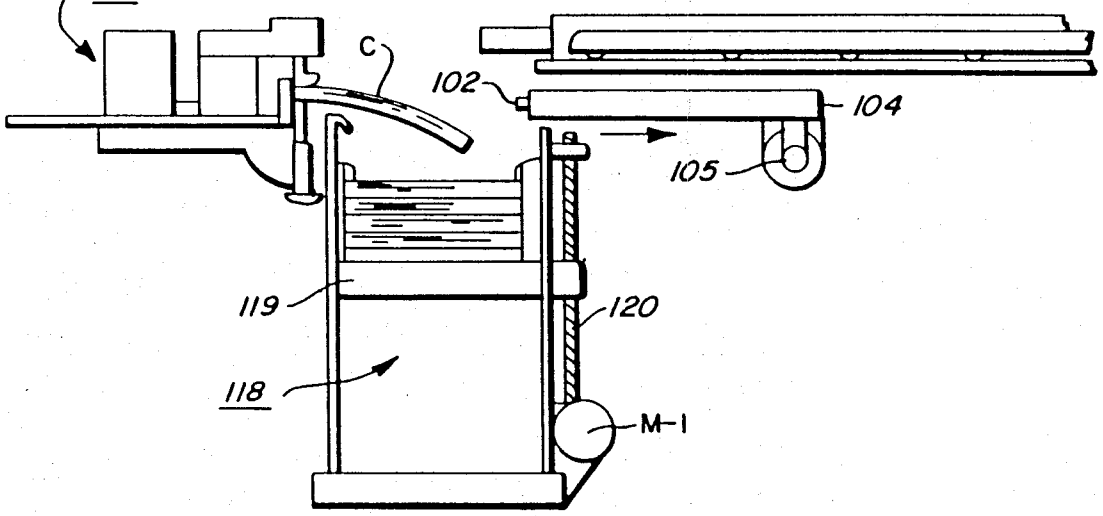
FIG. 3 is a partial enlarged view of the finishing station with parts in another position of operation.

Corresponding copy sheets are produced in collated arangement in the processor 11 and exited at the slot 50 in succeeding order in accordance with the production rate for the processor. Since the present invention is arranged so that there will be no skipped pitches in the production run, the copy sheets will be evenly spaced throughout processing, for all twenty times five, or one hundred sheets set to be produced. The first five copy sheets, corresponding to the first complete cycling of the document apparatus 12 are transported by way of the transport 92, through the reference point 93 and into the compiling station to be collected for a stapling operation. Each of these sheets is conveyed to and upon the top surface of the plate 102 and into the clamping position for the stapling heads 112, the leading edges of the sheets being registered by the devices 114,115. At the instant the fifth sheet is so positioned, so as to complete the collection of the first copy set, the clamping clutches for stapling heads are activated to clamp the adjacent edge of the collected set. Simultaneous with this action, the compiling plate 102 is retracted to permit the lowering of the opposite or trailing edge of the set, as shown in FIG. 3. This plate is returned immediately to its compiling position as shown in FIG. 1 so as to be in position to receive the first sheet of the second set of five copy sheets being transported. Immediately after the leading edge of the first set was clamped, the clutch for providing the force to drive staples through this edge and the clinching solenoid are activated in timed sequence to produce a stapled set. The forward registration device 114 may be suitably connected to a kicker driving mechanism and timed in its actuation to kick the stapled edge out of the stapling positions of the heads 112 at the instant before the plate 102 is returned. With the far portions of the stapled set already in position below the level of the plate 102 and dropping, the final kick of the set causes immediate lowering of the set and out of the return path of the plate.

The timing sequences provided in the logic for the programmer P for the activations enumerated above: clamping by the stapling heads, retraction of the plate 102, staple driving and clinching, final kicking of a completed copy set, and return of the plate 102. Final kicking of a completed copy set is such that the compiling plate 102 is returning to the compiling station as the first copy sheet of a succeeding copy set being produced. The logic will determine when these actions are to occur by way of operator manipulation of the programmer P during presetting of the desired reproduction run. As the stapled sets are produced, one by one they fall upon the elevator tray 119 which lowers in accordance with the sensed height of the topmost set thereon.

From the foregoing it will be apparent that an electrostatographic system with finishing station has been described which will produce stapled collated sets at a high production rate without loss of throughput, in fact, at a rate in accordance with the full processing speed of the copy processing machine. Furthermore, it will be apparent that the present invention accomplishes high speed stapling or stitching with a minimum of parts especially a minimum of moving parts thus minimizing maintenance calls and down time.

While the invention has been disclosed with refernce to the structure disclosed, it is not confined to the details set forth but is intended to cover such modifications or changes as may come within the scope of the following claims.

We claim:

1. In a reproduction system having a document handling apparatus adapted to transport individual document sheets from a supply stack to an exposure station and effecting an exposure of each of the document sheets before returning the same to the supply stack, and a processor for reproducing copy sheets of the exposed sheets, the combination of:

a finishing apparatus adapted to receive collated sets of copy sheets of a set of document sheets and to bind the same, said apparatus including at least one stapling device having a clamping position whereat a staple is driven through a set of copy sheets during a stapling operation, said finishing apparatus including a compiling station whereat collated copy sheets are collected and having a movable member upon which, in a supporting position, sheets are supported during collection in a set prior to binding, said member being movable in a generally horizontal plane and arranged to guide sheets along the same while being moved into said clamping position, means for registering the copy sheets being collected along the leading edge thereof to provide an aligned edge for the set being collected, said aligned edge being within said clamping position of said stapling device whereby stapling of the set may be enacted along said edge without further movement of said set, and means for moving said member out of said supporting position during the stapling operation to effect removal of the set from said compiling station.

2. The reproduction system of claim 1, wherein said member comprises a sheet accumulating and supporting device movable to a first generally horizontal supporting position, adjacent to and cooperating with said clamping position, whereat said copy sheets are accumulated in a generally horizontally stacked collated set prior to said binding operation, said supporting device being adapted to guide an edge of the sheets into said binding position, said sheet accumulating and supporting device being movable to a second, non-sheet supporting position in which the accumulated and bound collated set of copy sheets is released to fall by gravity to a generally horizontal set receiving station thereunder for generally horizontal automatic stacking of plural said bound sets.

3. The reproduction system of claim 2, further including means for conveying the copy sheets onto said member at an overall rate equal to the process rate for reproducing copy sheets, thereby maintaining reproduction rate productivity, and said means for moving said member out of said supporting position producing rapid movement of said sheet accumulating and supporting device after collection of a copy set from said first position to said second position and back to said first position in a time period approximately equal to said process rate for reproducing one copy sheet, thereby maintaining reproduction rate productivity.

* * * * *